US009140463B2

(12) United States Patent
Jo et al.

(10) Patent No.: US 9,140,463 B2
(45) Date of Patent: Sep. 22, 2015

(54) INDOOR UNIT WITH POWER SUPPLY AND POWER DETECTION CAPABILITIES AND METHOD THEREOF AND AIR CONDITIONING SYSTEM HAVING THE SAME

(75) Inventors: Su Ho Jo, Seongnam-si (KR); Kwan Joo Myoung, Suwon-si (KR); Awata Hiroshi, Seongnam-si (KR); O Do Ryu, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1070 days.

(21) Appl. No.: 13/067,339

(22) Filed: May 25, 2011

(65) Prior Publication Data

US 2011/0291487 A1 Dec. 1, 2011

(30) Foreign Application Priority Data

May 31, 2010 (KR) ..... 10-2010-0050889

(51) Int. Cl.
*F24F 11/00* (2006.01)

(52) U.S. Cl.
CPC ..... *F24F 11/0009* (2013.01); *F24F 2011/0068* (2013.01); *Y10T 307/696* (2015.04)

(58) Field of Classification Search
None
See application file for complete search history.

(56) References Cited

U.S. PATENT DOCUMENTS 5,262,679 A * 11/1993 Schweitzer et al. ..... 307/127
5,712,540 A * 1/1998 Toda et al. ..... 318/46
6,625,996 B2 * 9/2003 Nakajima et al. ..... 62/175
6,777,954 B2 * 8/2004 Yamada et al. ..... 324/543
7,053,502 B2 * 5/2006 Aihara et al. ..... 307/46

OTHER PUBLICATIONS

Chinese Office Action dated Oct. 8, 2014 in corresponding Chinese Patent Application No. 201110153414.4.

* cited by examiner

*Primary Examiner* — Rexford Barnie
*Assistant Examiner* — David Shiao
(74) *Attorney, Agent, or Firm* — Staas & Halsey LLP

(57) ABSTRACT

An indoor unit performs a control operation to not supply power to a load device through a power/communication line simultaneously with other indoor units. An air conditioning system may includes an indoor unit including a microcomputer to output a power application signal to supply power to a load device through a power/communication line, and a duplicate power application prevention unit to interrupt the power application signal from the microcomputer when the power is simultaneously applied to the power/communication line by a different indoor unit, to prevent the power from being duplicately applied to the power/communication line.

16 Claims, 8 Drawing Sheets

FIG. 4A

<FLOW WHEN POWER APPLICATION SIGNAL FROM MICROCOMPUTER IS TURNED ON UNDER CONDITION THAT P1 VOLTAGE IS HIGHER THAN P2 VOLTAGE OWING TO APPLICATION OF POWER TO POWER/COMMUNICATION LINE>

| LINE VOLTAGE CONDITIONS | 55a | 55b | 55c,56a | 56c,57b | 57a | 56b,57c | STATUS |
|---|---|---|---|---|---|---|---|
| FIRST CONDITION (P1 VOLTAGE > P2 VOLTAGE) | 1 | 0 | 0 | 0 | 0 | 0 | - |
| SECOND CONDITION (P1 VOLTAGE > P2 VOLTAGE) | 1 | 0 | 0 | 0 | 0 → 1 | 0 | POWER APPLICATION SIGNAL FROM MICROCOMPUTER IS TURNED ON |
| THIRD CONDITION (P1 VOLTAGE > P2 VOLTAGE) | 1 | 0 | 0 | 0 | 1 | 0 | POWER APPLICATION TO POWER/ COMMUNICATION LINE FAILS |

FIG. 4B

<FLOW WHEN POWER APPLICATION SIGNAL FROM MICROCOMPUTER IS TURNED ON UNDER CONDITION THAT P1 VOLTAGE IS LOWER THAN P2 VOLTAGE OWING TO APPLICATION OF POWER TO POWER/COMMUNICATION LINE>

| LINE VOLTAGE CONDITIONS | 55a | 55b | 55c,56a | 56c,57b | 57a | 56b,57c | STATUS |
|---|---|---|---|---|---|---|---|
| FIRST CONDITION (P1 VOLTAGE < P2 VOLTAGE) | 0 | 1 | 0 | 0 | 0 | 0 | - |
| SECOND CONDITION (P1 VOLTAGE < P2 VOLTAGE) | 0 | 1 | 0 | 0 | 0 → 1 | 0 | POWER APPLICATION SIGNAL FROM MICROCOMPUTER IS TURNED ON |
| THIRD CONDITION (P1 VOLTAGE < P2 VOLTAGE) | 0 | 1 | 0 | 0 | 1 | 0 | POWER APPLICATION TO POWER/ COMMUNICATION LINE FAILS |

FIG. 4C

<FLOW WHEN POWER APPLICATION SIGNAL FROM MICROCOMPUTER IS TURNED ON UNDER CONDITION THAT POWER IS NOT APPLIED TO POWER/COMMUNICATION LINE>

| LINE VOLTAGE CONDITIONS | 55a | 55b | 55c,56a | 56c,57b | 57a | 56b,57c | STATUS |
|---|---|---|---|---|---|---|---|
| FIRST CONDITION (NO POWER) | 1 | 1 | 1 | 1 | 0 | 0 | - |
| SECOND CONDITION (NO POWER) | 1 | 1 | 1 | 1 | 0 → 1 | 0 | POWER APPLICATION SIGNAL FROM MICROCOMPUTER IS TURNED ON |
| THIRD CONDITION (P1 VOLTAGE > P2 VOLTAGE) | 1 | 1 | 1 | 1 | 1 | 0 → 1 | POWER IS APPLIED TO POWER/COMMUNICATION |
| FOURTH CONDITION (P1 VOLTAGE > P2 VOLTAGE) | 1 | 1 → 0 | 1 | 1 | 1 | 1 | POWER OF POWER/COMMUNICATION LINE IS FED BACK |
| FIFTH CONDITION (P1 VOLTAGE > P2 VOLTAGE) | 1 | 0 | 1 → 0 | 1 | 1 | 1 | OUTPUT OF AND GATE IS CHANGED |
| SIXTH CONDITION (P1 VOLTAGE > P2 VOLTAGE) | 1 | 0 | 0 | 1 | 1 | 1 | VOLTAGE ON POWER/COMMUNICATION LINE IS MAINTAINED |

FIG. 4D

<FLOW WHEN POWER APPLICATION SIGNAL FROM MICROCOMPUTER IS TURNED OFF UNDER CONDITION THAT INDOOR UNIT DIRECTLY APPLIES POWER TO POWER/COMMUNICATION LINE>

| LINE VOLTAGE CONDITIONS | 55a | 55b | 55c,56a | 56c,57b | 57a | 56b,57c | STATUS |
|---|---|---|---|---|---|---|---|
| FIRST CONDITION (P1 VOLTAGE > P2 VOLTAGE) | 1 | 0 | 0 | 1 | 1 | 1 | POWER APPLICATION TO POWER/ COMMUNICATION LINE IS MAINTAINED |
| SECOND CONDITION (P1 VOLTAGE > P2 VOLTAGE) | 1 | 0 | 0 | 1 | 1 → 0 | 1 | POWER APPLICATION SIGNAL FROM MICROCOMPUTER IS TURNED OFF |
| THIRD CONDITION (NO POWER) | 1 | 0 | 0 | 1 | 0 | 1 → 0 | POWER TO POWER/COMMUNICATION LINE IS TURNED OFF |
| FOURTH CONDITION (NO POWER) | 1 | 0 → 1 | 0 | 1 → 0 | 0 | 0 | POWER OF POWER/COMMUNICATION LINE IS FED BACK |
| FIFTH CONDITION (NO POWER) | 1 | 1 | 0 → 1 | 0 | 0 | 0 | VOLTAGE ON POWER/COMMUNICATION LINE IS MAINTAINED |
| SIXTH CONDITION (NO POWER) | 1 | 1 | 1 | 0 → 1 | 0 | 0 | VOLTAGE ON POWER/COMMUNICATION LINE IS MAINTAINED |
| SEVENTH CONDITION (NO POWER) | 1 | 1 | 1 | 1 | 0 | 0 | VOLTAGE ON POWER/COMMUNICATION LINE IS MAINTAINED |

INDOOR UNIT WITH POWER SUPPLY AND POWER DETECTION CAPABILITIES AND METHOD THEREOF AND AIR CONDITIONING SYSTEM HAVING THE SAME

CROSS-REFERENCE TO RELATED APPLICATIONS

This application claims the benefit of Korean Patent Application No. 10-2010-0050889, filed on May 31, 2010 in the Korean Intellectual Property Office, the disclosure of which is incorporated herein by reference.

BACKGROUND

1. Field

Example embodiments relate to an indoor unit to supply power to a load device, a method thereof and an air conditioning system having the same.

2. Description of the Related Art

In general, an air conditioner is an apparatus that is used to cool or heat a room. In the air conditioner, a refrigerant is circulated between an indoor unit and an outdoor unit, and a cooling or heating operation is performed based on the principle that the refrigerant absorbs ambient heat when evaporated from a liquefied state and discharges the heat when liquefied.

An air conditioner generally has one outdoor unit and one indoor unit connected to the outdoor unit. Recently, users have increasingly demanded a system air conditioner in which a plurality of indoor units with various shapes and volumes are connected to one or more outdoor units to perform a cooling or heating operation with respect to a place having a number of divided spaces, such as a school, company or hospital.

For example, such a system air conditioner may include one outdoor unit and a plurality of indoor units, and a direct current (DC) power line, a communication line, etc. may be connected between the outdoor unit and each indoor unit to enable communication between the outdoor unit and each indoor unit.

On the other hand, in a system air conditioner, a plurality of indoor units may often be controlled by a wired remote controller differently from those in a household air conditioner because a wireless remote controller may be lost. In the system air conditioner, the wired remote controller may be used in common for the indoor units and connected to the indoor units using a 2-line scheme. The 2-line scheme is a technique that links a communication signal to a power supply line and transmits power and the communication signal together through the power supply line (the power supply line that is linked with the communication signal and transmits the communication signal will hereinafter be referred to as a "power/communication line"). The indoor units may supply powers to the wired remote controller through the power/communication line. If the indoor units simultaneously supply the powers to the power/communication line, a short circuit may occur, resulting in a fault.

SUMMARY

Therefore, it is an aspect of the example embodiments to provide an indoor unit that performs a control operation to not supply power to a load device through a power/communication line simultaneously with other indoor units, a method thereof, and an air conditioning system having the same.

The foregoing and/or other aspects are achieved by providing an indoor unit which supplies power to a load device externally connected thereto through a power/communication line including a microcomputer to output a power application signal to supply the power to the load device, and a duplicate power application prevention unit to interrupt the power application signal from the microcomputer when the power is simultaneously applied to the power/communication line by a different indoor unit, to prevent the power from being duplicately applied to the power/communication line.

The duplicate power application prevention unit may interrupt the power application signal from the microcomputer according to a voltage on the power/communication line to prevent the power from being duplicately applied to the power/communication line.

The power/communication line may include a first power/communication line and a second power/communication line, wherein the duplicate power application prevention unit may include a first AND gate to receive a voltage on the first power/communication line and a voltage on the second power/communication line as input.

The duplicate power application prevention unit may further include an OR gate to receive an output signal from the first AND gate as input.

The duplicate power application prevention unit may further include a second AND gate to receive an output signal from the OR gate and the power application signal from the microcomputer as input.

The duplicate power application prevention unit may further include a first transistor and a second transistor switched in response to an output signal from the second AND gate.

The indoor unit may further include a load device power supply to supply the power to the load device, wherein the load device power supply may supply the power to the load device when the first transistor and the second transistor are turned on.

The microcomputer may determine whether the power is applied to the power/communication line, and output the power application signal upon determining that the power is not applied to the power/communication line.

The foregoing and/or other aspects are achieved by providing an air conditioning system including a load device, and an indoor unit including a microcomputer to output a power application signal to supply power to the load device through a power/communication line, and a duplicate power application prevention unit to interrupt the power application signal from the microcomputer when the power is simultaneously applied to the power/communication line by a different indoor unit, to prevent the power from being duplicately applied to the power/communication line.

The indoor unit may further include a load device power supply to supply the power to the load device.

The duplicate power application prevention unit may include a logic circuit to receive a voltage applied to the power/communication line and the power application signal from the microcomputer as input.

The logic circuit may include a first AND gate to receive the voltage applied to the power/communication line as input.

The logic circuit may further include an OR gate to receive an output signal from the first AND gate as input.

The logic circuit may further include a second AND gate to receive an output signal from the OR gate and the power application signal from the microcomputer as input.

The duplicate power application prevention unit may further include a first transistor and a second transistor switched in response to an output signal from the second AND gate.

The foregoing and/or other aspects are achieved by providing a method including outputting, by a processor, a signal from a first indoor air conditioning unit to supply power to a load device via a power/communication line and preventing, by the processor, the first indoor air conditioning unit from supplying power to the load device when power is simultaneously supplied by a second indoor air conditioning unit.

Additional aspects, features, and/or advantages of embodiments will be set forth in part in the description which follows and, in part, will be apparent from the description, or may be learned by practice of the disclosure.

BRIEF DESCRIPTION OF THE DRAWINGS

These and/or other aspects and advantages will become apparent and more readily appreciated from the following description of the embodiments, taken in conjunction with the accompanying drawings of which:

FIG. 4A is a table illustrating digital signals at input/output terminals of a logic circuit when a voltage on a first power/communication line is higher than a voltage on a second power/communication line owing to application of power to the power/communication line;

FIG. 4B is a table illustrating digital signals at the input/output terminals of the logic circuit when the voltage on the first power/communication line is lower than the voltage on the second power/communication line owing to application of the power to the power/communication line;

FIG. 4C is a table illustrating digital signals at the input/output terminals of the logic circuit when the power is not applied to the power/communication line; and FIG. 4D is a table illustrating digital signals at the input/output terminals of the logic circuit when a microcomputer turns off a power application signal when the power is applied to the power/communication line.

DETAILED DESCRIPTION

Figure 1:
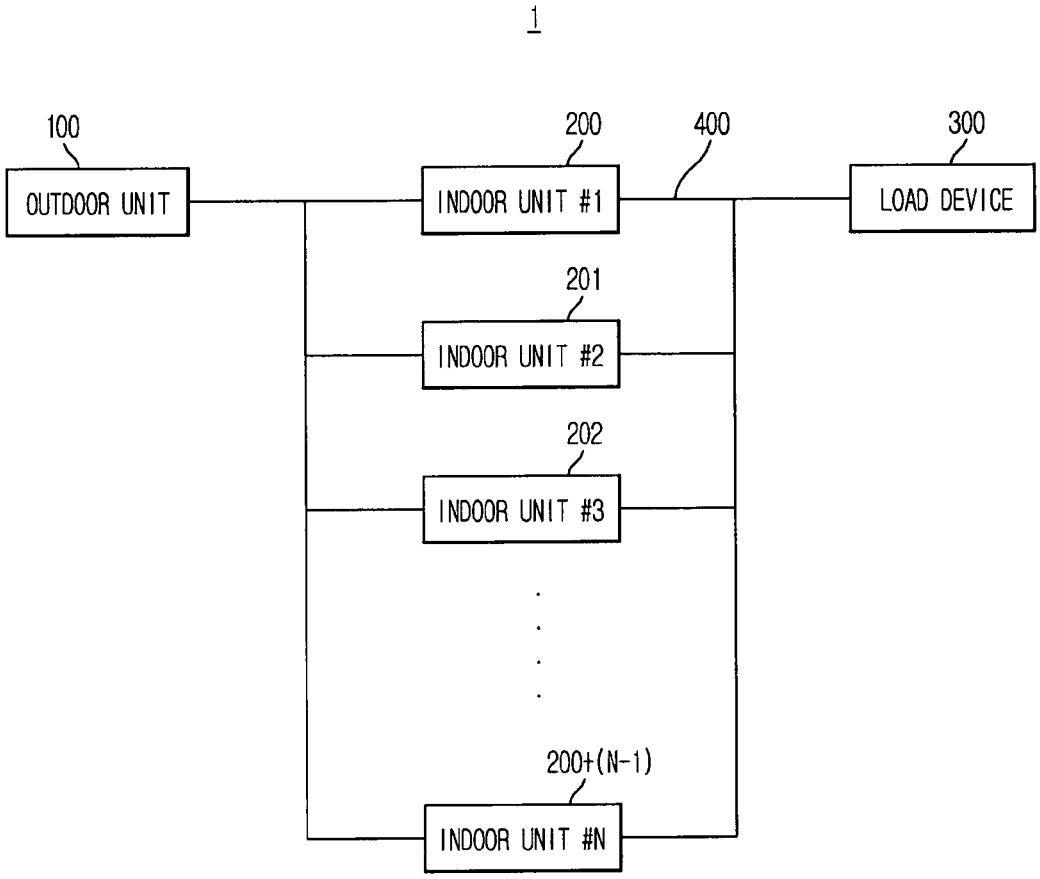
FIG. 1 is a block diagram of an air conditioning system according to example embodiments.

Reference will now be made in detail to embodiments, examples of which are illustrated in the accompanying drawings, wherein like reference numerals refer to like elements throughout.

FIG. 1 is a block diagram of an air conditioning system according to example embodiments.

The air conditioning system, denoted by reference numeral 1, may include an outdoor unit 100, a plurality of indoor units 200 to 200+N−1 connected to the outdoor unit 100, and a load device 300 connected to the indoor units 200 to 200+N−1.

The indoor units 200 to 200+N−1 may be connected with the load device 300 via a power/communication line 400. The connection between the indoor units 200 to 200+N−1 and the load device 300 may be made using a 2-line scheme. The 2-line scheme is a scheme in which power and a communication signal may be transmitted through the same line.

The load device 300 may include a wired remote controller to operate the indoor units 200 to 200+N−1 or a sensor to sense a temperature, humidity or the like. The load device 300 may be supplied with powers from the indoor units 200 to 200+N−1. When a forward polarity connection is made between the load device 300 and the indoor units 200 to 200+N−1, the simultaneous application of powers from the indoor units 200 to 200+N−1 to the power/communication line 400 do not matter. However, when a reverse polarity connection is made between the load device 300 and the indoor units 200 to 200+N−1, the simultaneous application of the powers from the indoor units 200 to 200+N−1 to the power/communication line 400 may cause a short circuit, resulting in a fault, as will hereinafter be described in detail with reference to FIGS. 2A and 2B.

Figure 2A:
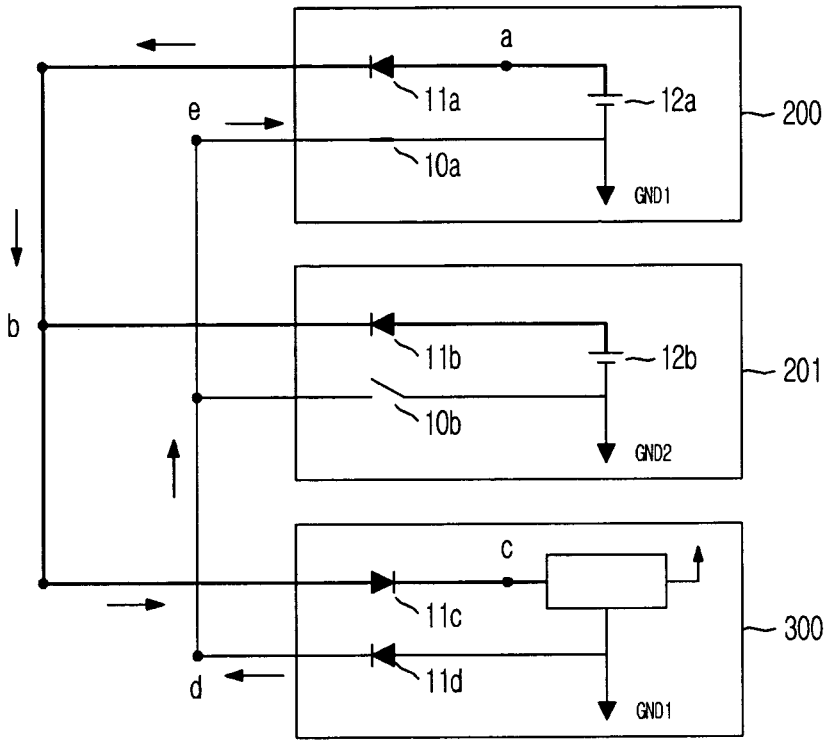
FIG. 2A is a circuit diagram showing a forward polarity connection between a plurality of indoor units and a load device.
Figure 2B:
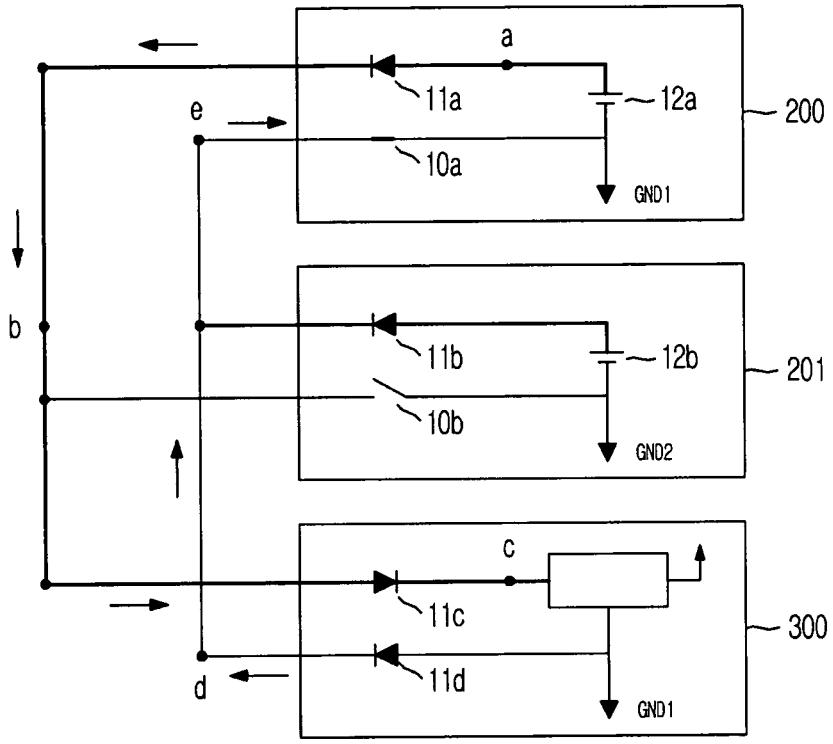
FIG. 2B is a circuit diagram showing a reverse polarity connection between a plurality of indoor units and a load device.

FIG. 2A is a circuit diagram showing a forward polarity connection between a plurality of indoor units and a load device, and FIG. 2B is a circuit diagram showing a reverse polarity connection between a plurality of indoor units and a load device.

As shown in FIG. 2A, the indoor units 200 and 201 may be connected to the load device 300 according to the 2-line scheme. First to fourth diodes 11*a* to 11*d* may be provided in the indoor units 200 and 201 and the load device 300 to enable current to flow in only one direction.

The indoor units 200 and 201 may include power supply ports 10*a* and 10*b*, respectively. The power supply ports 10*a* and 10*b* may be on/off-controlled to supply powers from the corresponding indoor units 200 and 201 to the load device 300. The power supply ports 10*a* and 10*b* may include transistors capable of performing switching operations. In order to supply the powers from the indoor units 200 and 201 to the load device 300, the power supply ports 10*a* and 10*b* may be turned on to form closed circuits.

Referring to FIG. 2A, when the power supply port 10*a* of the indoor unit #1 200 is turned on, current flows from a power supply 12*a* of the indoor unit #1 200 to the load device 300 through the first diode 11*a* and then may be fed from the load device 300 back to the indoor unit #1 200 through the third diode 11*c* (i.e., a→b→c→d→e). On the other hand, the "+" pole of the power supply 12*a* of the indoor unit #1 200 may be connected to the "+" pole of a power supply 12*b* of the indoor unit #2 201 and the "−" pole thereof is connected to the "−" pole of the power supply 12*b* of the indoor unit #2 201. The forward polarity connection means that the "+" pole of any one 12*a* or 12*b* of the plurality of power supplies 12*a* and 12*b* may be connected to the "+" pole of another one 12*b* or 12*a* and the "−" pole thereof may be connected to the "−" pole of another one 12*b* or 12*a*. Provided that the forward polarity connection is made between the power supplies 12*a* and 12*b* of the plurality of indoor units 200 and 201, a short phenomenon may not occur even if the indoor units 200 and 201 simultaneously supply powers to the load device 300.

Referring to FIG. 2B, in contrast to FIG. 2A, the "+" pole of the power supply 12*a* of the indoor unit #1 200 may be connected to the "−" pole of the power supply 12*b* of the indoor unit #2 201 and the "−" pole thereof may be connected to the "+" pole of the power supply 12*b* of the indoor unit #2 201. The reverse polarity connection means that the "+" pole of any one 12*a* or 12*b* of the plurality of power supplies 12*a* and 12*b* may be connected to the "−" pole of another one 12*b* or 12*a* and the "−" pole thereof may be connected to the "+" pole of another one 12*b* or 12*a*. Provided that the reverse polarity connection is made between the plurality of power supplies 12*a* and 12*b*, the simultaneous application of powers from the power supplies 12*a* and 12*b* may cause a short circuit, resulting in a fault. In order to solve this problem, an aspect of the example embodiments may include providing internal circuits of the indoor units 200 to 200+N−1 that prevent the plurality of power supplies 12*a* and 12*b* from simultaneously applying powers to the power/communication line 400. Hereinafter, a detailed description will be given of the internal circuit of the indoor unit #1 200 among the plurality of indoor units 200 to 200+N−1, as the subject, with reference to FIG. 3.

Figure 3:
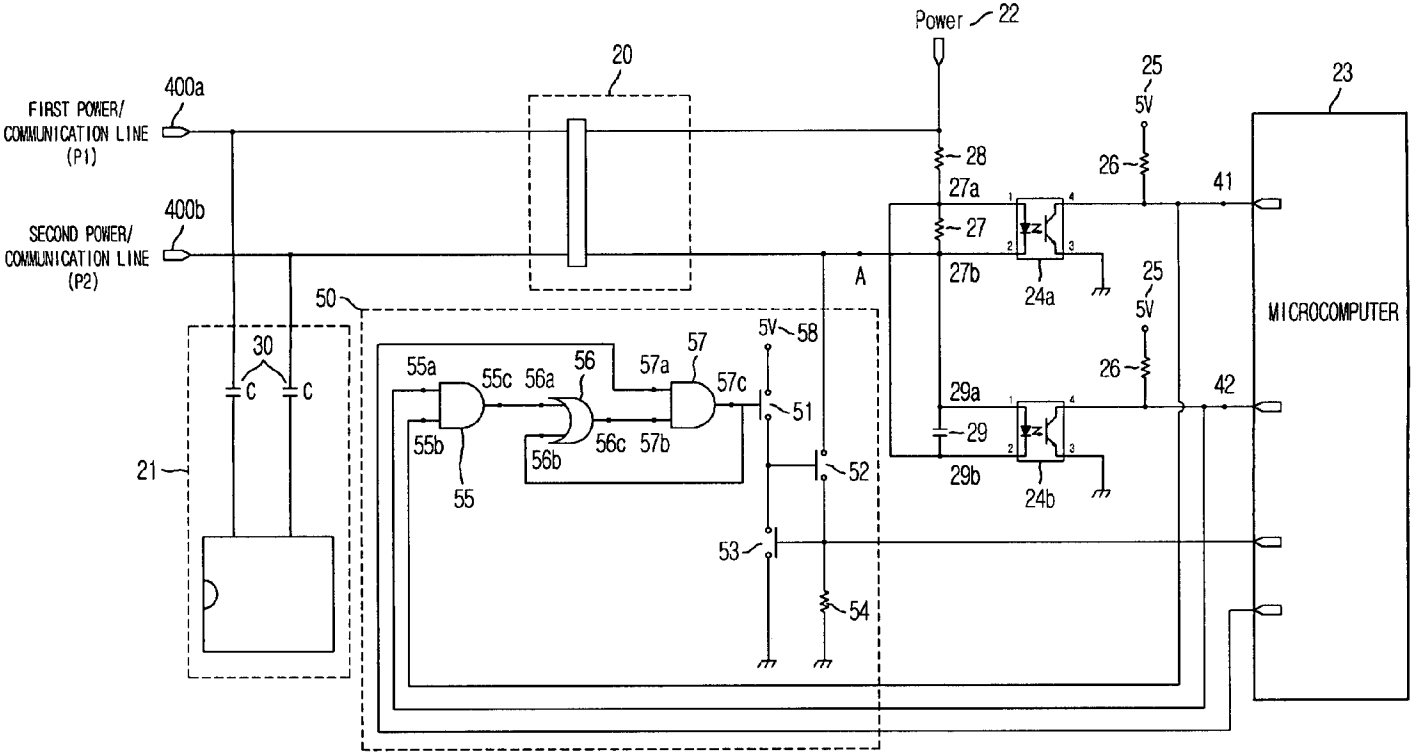
FIG. 3 is a circuit diagram of an internal circuit of an indoor unit that prevents a plurality of powers from being duplicately applied to a power/communication line, according to example embodiments.

FIG. 3 is a circuit diagram of an internal circuit of an indoor unit that prevents a plurality of powers from being duplicately applied to a power/communication line, according to example embodiments. Here, a voltage 0~1V indicates a digital signal "0" and a voltage 1~6V indicates a digital signal "1".

The internal circuit of the indoor unit 200 may include a power/communication separator 20 to separate a signal input to the power/communication line 400 into power and a communication signal, a communication module 21 to receive the communication signal of the input signal and analyze information of the communication signal, a load device power supply 22 to supply the power to the load device 300, a microcomputer 23 to determine whether the power is applied to the power/communication line 400 and, if the power is not applied to the power/communication line 400, output a power application signal such that the power is applied to the power/communication line 400, and a duplicate power application prevention unit 50 to interrupt duplicate power application based on the control of the microcomputer 23 when the power is applied to the power/communication line 400 by a different indoor unit 201 to 200+N−1 (N≥3).

The microcomputer 23 may determine whether the power is applied to the power/communication line 400 by the different indoor unit 201 to 200+N−1 (N≥3). The microcomputer 23 may check voltages at a first point 41 and a second point 42 to determine whether the power is applied to the power/communication line 400.

When digital signals corresponding to voltages applied to the first point 41 and second point 42 are "1s", the microcomputer 23 may determine that the power is not applied to the power/communication line 400 by the different indoor unit 201 to 200+N−1 (N≥3). When the power is not applied to the power/communication line 400, a first photocoupler 24*a* and a second photocoupler 24*b* do not conduct. When the first photocoupler 24*a* and second photocoupler 24*b* do not conduct, 5V is applied to each of the first point 41 and second point 42 by a voltage source 25 for voltage determination. As a result, a digital signal corresponding to the voltage applied to the first point 41 is "1" and a digital signal corresponding to the voltage applied to the second point 42 is "1". Consequently, when the digital signals corresponding to the voltages applied to the first point 41 and second point 42 are "1s", the microcomputer 23 may determine that the power is not applied to the power/communication line 400 by the different indoor unit 201 to 200+N−1 (N≥3).

When the digital signal corresponding to the voltage applied to any one 41 or 42 of the first point 41 or second point 42 is "0", the microcomputer 23 may determine that the power is applied to the power/communication line 400 by the different indoor unit 201 to 200+N−1 (N≥3). When the power is applied to the power/communication line 400 by the different indoor unit 201 to 200+N−1 (N≥3), any one of the first photocoupler 24*a* and second photocoupler 24*b* may conduct. For example, when a voltage on a first power/communication line 400*a* is 12V and a voltage on a second power/communication line 400*b* is 0V, the voltage on the first power/communication line 400*a* may be divided by a second resistor 27, thereby causing a voltage at an upper end 27*a* of the second resistor 27 to be higher than a voltage at a lower end 27*b* of the second resistor 27. As a result, the first photocoupler 24*a* may conduct. Also, because the upper end 27*a* of the second resistor 27 may be electrically connected to a lower end 29*b* of a second capacitor 29 and the lower end 27*b* of the second resistor 27 may be electrically connected to an upper end 29*a* of the second capacitor 29, a voltage at the lower end 29*b* of the second capacitor 29 may be higher than a voltage at the upper end 29*a* of the second capacitor 29. When the voltage at the lower end 29*b* of the second capacitor 29 is higher than the voltage at the upper end 29*a* of the second capacitor 29, the second photocoupler 24*b* does not conduct. If the first photocoupler 24*a* conducts, the first point 41 may be connected to ground, so that the voltage at the first point 41 becomes 0V. As a result, the microcomputer 23 may determine, from the voltage at the first point 41, that the corresponding digital signal is "0". If the second photocoupler 24*b* does not conduct, 5V may be applied to the second point 42 by the voltage determination voltage source 25, so that the microcomputer 23 determines the corresponding digital signal to be "1".

Consequently, when the digital signal corresponding to the voltage applied to the first point 41 is "0" and the digital signal corresponding to the voltage applied to the second point 42 is "1", the microcomputer 23 may determine that the power is applied to the power/communication line 400.

For another example, when the voltage on the first power/communication line 400*a* is 0V and the voltage on the second power/communication line 400*b* is 12V, "0V" may be applied to the upper end 27*a* of the second resistor 27 and a certain voltage may be applied to the lower end 27*b* of the second resistor 27 by the voltage on the second power/communication line 400*b*. If the voltage at the upper end 27*a* of the second resistor 27 is lower than the voltage at the lower end 27*b* of the second resistor 27, the first photocoupler 24*a* may not conduct. Also, because the lower end 29*b* of the second capacitor 29 is connected with the upper end 27*a* of the second resistor 27 and the upper end 29*a* of the second capacitor 29 is connected with the lower end 27*b* of the second resistor 27, the voltage at the upper end 29*a* of the second capacitor 29 may be higher than the voltage at the lower end 29*b* of the second capacitor 29, thereby causing the second photocoupler 24*b* to conduct. If the second photocoupler 24*b* conducts, the second point 42 may be connected to the ground, so that the voltage at the second point 42 becomes 0V. As a result, the microcomputer 23 may determine, from the voltage at the second point 42, that the corresponding digital signal is "0". If the first photocoupler 24*a* does not conduct, 5V may be applied to the first point 41 by the voltage determination voltage source 25, so that the microcomputer 23 determines the corresponding digital signal to be "1".

Consequently, in the case where the digital signal corresponding to the voltage applied to the second point 42 is "0" and the digital signal corresponding to the voltage applied to the first point 41 is "1", the microcomputer 23 may determine that the power is applied to the power/communication line 400.

Upon determining that the power is not applied to the power/communication line 400 by the different indoor unit 201 to 200+N−1 (N≥3), the microcomputer 23 may apply a predetermined voltage (referred to hereinafter as an "output signal") to the duplicate power application prevention unit 50.

The duplicate power application prevention unit 50 may receive, as input, the output signal applied from the microcomputer 23 and the voltage applied to the power/communication line 400, perform a predetermined logic operation with respect to the inputs to provide its output, and switch a first transistor 51 and a second transistor 52 according to the output to prevent the power from being duplicately applied to the power/communication line 400.

The duplicate power application prevention unit 50 may include a logic circuit. The logic circuit may include two AND gates 55 and 57 and one OR gate 56. The first AND gate 55 may receive the voltage at the first point 41 and the voltage at the second point 42 as its inputs. The OR gate 56 may receive the output of the first AND gate 55 and the output of the second AND gate 57 as its inputs. The second AND gate 57 may receive the output of the OR gate 56 and the output of the microcomputer 23 as its inputs.

The duplicate power application prevention unit 50 may include the first transistor 51, which is switched (turned on/off) in response to the output of the second AND gate 57. The duplicate power application prevention unit 50 may include a transistor voltage source 58. When a predetermined signal is input to the base of the first transistor 51 according to the output of the second AND gate 57, the first transistor 51 is turned on. If the first transistor 51 is turned on, a predetermined signal may be input to the base of the second transistor 52 by the transistor voltage source 58, thereby causing the second transistor 52 to be turned on. If the second transistor 52 is turned on, a point A may be connected to the ground. When the point A is connected to the ground, the load device power supply 22 and the load device 300 constitute a closed circuit and the power from the load device power supply 22 may be applied to the load device 300.

The operation of the duplicate power application prevention unit 50 will be described later in detail with reference to FIGS. 4A to 4D.

On the other hand, in FIG. 3, when the first photocoupler 24*a* conducts, a first resistor 26 may allow current to flow from the voltage determination voltage source 25. The second resistor 27 may apply voltages across the first photocoupler 24*a* and second photocoupler 24*b*. A third resistor 28 may adjust the amounts of currents input to the first photocoupler 24*a* and second photocoupler 24*b*. A first capacitor 30 may only filter the communication signal of the power and communication signal input to the power/communication line 400, and the second capacitor 29 may remove noise from the currents input to the first photocoupler 24*a* and second photocoupler 24*b*.

FIGS. 4A to 4D are tables illustrating the operation of the duplicate power application prevention unit 50 according to example embodiments.

FIG. 4A illustrates digital signals at input/output terminals of the logic circuit when the voltage on the first power/communication line 400*a* is higher than the voltage on the second power/communication line 400*b* owing to application of the power to the power/communication line 400.

A first condition may be a condition in which the power is applied to the power/communication line 400 by the different indoor unit 201 to 200+N−1 (N≥3) and the power application signal is not output from the microcomputer 23. In the first condition, when the voltage on the first power/communication line 400*a* is higher than the voltage on the second power/communication line 400*b*, the voltage at the first point 41 may become "0V" and the voltage at the second point 42 may become "5V". As a result, a digital signal "1" may be input to a first input terminal 55*a* of the first AND gate 55, a digital signal "0" may be input to a second input terminal 55*b* of the first AND gate 55, and a digital signal "0" may be output at an output terminal 55*c* of the first AND gate 55. The digital signal "0" from the output terminal 55*c* of the first AND gate 55 may be input to a first input terminal 56*a* of the OR gate 56 and the output signal from the second AND gate 57 may be input to a second input terminal 56*b* of the OR gate 56. Because the output signal from the microcomputer 23, input to a first input terminal 57*a* of the second AND gate 57 is "0", the output signal from the second AND gate 57 may become "0". As a result, the output signal from the OR gate 56 may become "0". Since the output signal from the microcomputer 23, input to the first input terminal 57*a* of the second AND gate 57, and the output signal from the OR gate 56, input to a second input terminal 57*b* of the second AND gate 57 are both "0", "0" may be output at an output terminal 57*c* of the second AND gate 57. When the output signal from the output terminal 57*c* of the second AND gate 57 is "0", the first transistor 51 and the second transistor 52 may not be turned on. Consequently, the load device 300 and the load device power supply 22 may not constitute a closed circuit and thus the power is not applied to the power/communication line 400.

On the other hand, it will be readily understood from FIG. 2A or 2B that the load device 300 and the load device power supply 22 may constitute a closed circuit and the power is thus applied to the power/communication line 400. It can be conceptually seen from FIG. 2A or 2B that the indoor unit 200 and the load device 300 may constitute a closed circuit when the power supply port 10*a* is turned on. In FIG. 2A or 2B, the power supply port 10*a* may correspond to the first transistor 51 in FIG. 3.

Second and third conditions may be conditions in which the power is applied to the power/communication line 400 by the different indoor unit 201 to 200+N−1 (N≥3) and the power application signal is output from the microcomputer 23. The microcomputer 23 may output the power application signal due to a software error even though the power is applied to the power/communication line 400. The second condition may be different from the first condition because the output signal from the microcomputer 23 is changed from "0" to "1". The third condition may be a condition in which the power is not duplicately applied to the power/communication line 400 because the output of the second AND gate 57 is "0" although the output signal from the microcomputer 23 was changed from "0" to "1" in the second condition.

In the third condition, similar to in the first condition, the output of the output terminal 57*c* of the second AND gate 57 may be "0", thereby causing the first transistor 51 and the second transistor 52 not to be turned on, so that the power is not applied to the power/communication line 400. As a result, even though the microcomputer 23 outputs the power application signal due to a software error, the duplicate power application prevention unit 50 may interrupt the power application signal, to prevent the power from being duplicately applied to the power/communication line 400.

FIG. 4B illustrates digital signals at the input/output terminals of the logic circuit when the voltage on the first power/communication line 400*a* may be lower than the voltage on the second power/communication line 400*b* as a result of application of the power to the power/communication line 400.

In a first condition, when the voltage on the first power/communication line 400*a* is lower than the voltage on the second power/communication line 400*b*, the voltage at the first point 41 becomes "5V" and the voltage at the second point 42 may become "0V". As a result, a digital signal "0" may be input to the first input terminal 55*a* of the first AND gate 55, a digital signal "1" may be input to the second input terminal 55*b* of the first AND gate 55, and a digital signal "0" may be output at the output terminal 55*c* of the first AND gate 55. The digital signal "0" from the output terminal 55*c* of the first AND gate 55 may be input to the first input terminal 56*a* of the OR gate 56 and the output of the second AND gate 57 may be input to the second input terminal 56*b* of the OR gate 56. Because the output signal from the microcomputer 23, input to the first input terminal 57*a* of the second AND gate 57 is "0", the output of the second AND gate 57 may become "0". As a result, the output of the OR gate 56 may become "0". Since the output signal from the microcomputer 23 input to the first input terminal 57*a* of the second AND gate 57, and the output signal from the OR gate 56 input to the second input terminal 57*b* of the second AND gate 57 are both "0", "0" may be output at the output terminal 57*c* of the second AND gate 57. When the output signal from the output terminal 57*c* of the second AND gate 57 is "0", the first transistor 51 and the second transistor 52 may not be turned on. Consequently, no closed circuit may be created and thus the power is not applied to the power/communication line 400.

Second and third conditions may be conditions in which the power is applied to the power/communication line 400 by the different indoor unit 201 to 200+N−1 (N≥3) and the power application signal is output from the microcomputer 23. The second condition may be different from the first condition because the output signal from the microcomputer 23 is changed from "0" to "1". In the third condition, similar to in the first condition, the output of the output terminal 57*c* of the second AND gate 57 may be "0", thereby causing the first transistor 51 and the second transistor 52 not to be turned on, so that the power is not applied to the power/communication line 400.

FIG. 4C illustrates digital signals at the input/output terminals of the logic circuit under the condition that the power may not be applied to the power/communication line 400.

A first condition may be a condition in which the power application signal from the microcomputer 23 is not output under the condition that the power is not applied to the power/communication line 400. When the power is not applied to the first power/communication line 400*a* and the second power/communication line 400*b*, 5V may be applied to each of the first point 41 and second point 42. As a result, a digital signal "1" may be input to each of the first input terminal 55*a* and second input terminal 55*b* of the first AND gate 55, and a digital signal "1" may be output at the output terminal 55*c* of the first AND gate 55. The output signal "1" from the first AND gate 55 may be input to the first input terminal 56*a* of the OR gate 56 and the output signal from the second AND gate 57 may be input to the second input terminal 56*b* of the OR gate 56. Notably, because the signal "1" may be input to the first input terminal 56*a* of the OR gate 56, "1" may be output at the output terminal 56*c* of the OR gate 56 irrespective of the signal to the second input terminal 56*b* of the OR gate 56. Also, "0" may be input to the first input terminal 57*a* of the second AND gate 57 because the power application signal from the microcomputer 23 is not output yet, and the output signal "1" from the OR gate 56 may be input to the second input terminal 57*b* of the second AND gate 57. As a result, "0" may be output at the output terminal 57*c* of the second AND gate 57.

A second condition may be a condition in which the power application signal from the microcomputer 23 is output under the condition that the power is not applied to the power/communication line 400. When the power application signal from the microcomputer 23 is output, a digital signal "1" may be input to the first input terminal 57*a* of the second AND gate 57.

A third condition may be a condition in which there is a change in the output voltage from the output terminal 57*c* of the second AND gate 57 due to the output of the power application signal from the microcomputer 23 under the condition that the power is not applied to the power/communication line 400. In the second condition, when the digital signal "1" is input to the first input terminal 57*a* of the second AND gate 57 and the output signal "1" from the output terminal 56*c* of the OR gate 56 is input to the second input terminal 57*b* of the second AND gate 57, "1" may be output at the output terminal 57*c* of the second AND gate 57, thereby causing the first transistor 51 to be turned on. As the first transistor 51 is turned on, the second transistor 52 may be turned on by 5V, to connect the point A to the ground. As a result, the load device power supply 22 and the load device 300, not shown, may constitute a closed circuit, and the power is supplied to the load device 300.

Fourth to sixth conditions may be conditions in which the indoor unit 200 directly applies the power to the power/communication line 400 and the corresponding information is fed back to the indoor unit 200. In the fourth condition, the power may be applied to the power/communication line 400 and the voltage applied to the first power/communication line 400*a* may be higher than the voltage applied to the second power/communication line 400*b*. If the voltage applied to the first power/communication line 400*a* is higher than the voltage applied to the second power/communication line 400*b*, the first photocoupler 24*a* may conduct and the second photocoupler 24*b* may not conduct. When the first photocoupler 24*a* conducts, the first point 41 may be connected to the ground, so that the voltage at the first point 41 becomes 0V. When the second photocoupler 24*b* does not conduct, 5V may be applied to the second point 42 by the voltage determination voltage source 25. As a result, "0" may be input to the second input terminal 55*b* of the first AND gate 55, which receives the voltage at the first point 41 as its input. In the fifth condition, as the input to the second input terminal 55*b* of the first AND gate 55 is changed from "1" to "0", the voltage at the output terminal 55*c* of the first AND gate 55 may be changed from "1" to "0". In the sixth condition, although the voltage at the output terminal 55*c* of the first AND gate 55 has been changed from "1" to "0", the voltage at the output terminal 57*c* of the second AND gate 57 may be kept at "1", so that the voltage on the power/communication line 400 is maintained. Even though the indoor unit 200 directly applies the power to the power/communication line 400 and the applied power is fed back to the indoor unit 200, the indoor unit 200 may not determine the power to be applied by the different indoor unit 201 to 200+N−1 (N≥3), and continuously apply the power.

FIG. 4D illustrates digital signals at the input/output terminals of the logic circuit when the microcomputer 23 turns off the power application signal when the power is applied to the power/communication line 400.

A first condition may be the same as the sixth condition of FIG. 4C. A second condition may be a condition in which the input to the first input terminal 57*a* of the second AND gate 57 is changed from "1" to "0" when the microcomputer 23 turns off the power application signal.

A third condition may be a condition in which the signal at the output terminal 57*c* of the second AND gate 57 is changed from "1" to "0" as the input to the first input terminal 57*a* of the second AND gate 57 is changed from "1" to "0". As the signal at the output terminal 57*c* of the second AND gate 57 is changed from "1" to "0", the power applied to the power/communication line 400 may be turned off.

A fourth condition may be a condition in which the power-off state of the power/communication line 400 is fed back. In this fourth condition, the signal to the second input terminal 55*b* of the first AND gate 55 may be changed from "0" to "1" and the signal at the output terminal 56*c* of the OR gate 56 may be changed from "1" to "0".

A fifth condition may be a condition in which the output of the output terminal 55*c* of the first AND gate 55 is changed from "0" to "1" as the signal to the second input terminal 55*b* of the first AND gate 55 is changed from "0" to "1" in the fourth condition.

In sixth and seventh conditions, the signal at the output terminal 56*c* of the OR gate 56 may be changed from "0" to "1" as the signal at the output terminal 55*c* of the first AND gate 55 is changed from "0" to "1" in the fifth condition.

As is apparent from the above description, according to an aspect of the example embodiments, it may be possible to prevent a plurality of indoor units from simultaneously applying powers to a power/communication line, to avoid a circuit fault.

Although embodiments have been shown and described, it should be appreciated by those skilled in the art that changes may be made in these embodiments without departing from the principles and spirit of the disclosure, the scope of which is defined in the claims and their equivalents.

What is claimed is:

1. An indoor unit which supplies power to a load device externally connected to a power/communication line, the indoor unit comprising:

a microcomputer to output a power application signal to supply the power to the load device;

a duplicate power application prevention unit to interrupt the power application signal from the microcomputer when the power is simultaneously applied to the power/communication line by a different indoor unit, to prevent the power from being duplicately applied to the power/communication line; and at least two photo-couplers to optically isolate inputs of the duplicate power application prevention unit from a first power/communication line and a second power/communication line, wherein the power/communication line comprises the first power/communication line and the second power/communication line, and wherein the duplicate power application prevention unit comprises a first AND gate to receive a first signal which corresponds to a voltage on the first power/communication line and the first AND gate receives a second signal which corresponds to a voltage on the second power/communication line.

2. The indoor unit according to claim 1, wherein the duplicate power application prevention unit interrupts the power application signal from the microcomputer according to a voltage on the power/communication line to prevent the power from being duplicately applied to the power/communication line.

3. The indoor unit according to claim 1, wherein the duplicate power application prevention unit further comprises an OR gate to receive an output signal from the first AND gate as input.

4. The indoor unit according to claim 3, wherein the duplicate power application prevention unit further comprises a second AND gate to receive an output signal from the OR gate and the power application signal from the microcomputer as input.

5. The indoor unit according to claim 4, wherein the duplicate power application prevention unit further comprises a first transistor and a second transistor switched in response to an output signal from the second AND gate.

6. The indoor unit according to claim 5, further comprising a load device power supply to supply the power to the load device, wherein the load device power supply supplies the power to the load device when the first transistor and the second transistor are turned on.

7. The indoor unit according to claim 1, wherein the microcomputer determines whether the power is applied to the power/communication line, and outputs the power application signal upon determining that the power is not applied to the power/communication line.

8. The indoor unit according to claim 1, wherein the at least two photo-couplers optically isolate inputs of the microcomputer from the first power/communication line and the second power/communication line, and wherein the first power/communication line and the second power/communication line carry the supply of power and data signals for communication.

9. The indoor unit according to claim 1, wherein the first AND gate receives the first signal in a first input of the first AND gate and does not receive the second signal in the first input of the first AND gate, and wherein the first AND gate receives the second signal, which is from the microcontroller, in a second input of the first AND gate and does not receive the first signal, which is from the microcontroller, in the second input of the first AND gate.

10. An air conditioning system, comprising:

a load device; and an indoor unit comprising a microcomputer to output a power application signal to supply power to the load device through a power/communication line, a duplicate power application prevention unit to interrupt the power application signal from the microcomputer when the power is simultaneously applied to the power/communication line by a different indoor unit, to prevent the power from being duplicately applied to the power/communication line, and at least one photo-coupler to optically isolate at least one input of the duplicate power application prevention unit from the power/communication line, wherein the power/communication line comprises the first power/communication line and the second power/communication line, and wherein the duplicate power application prevention unit comprises a first AND gate to receive a first signal which corresponds to a voltage on the first power/communication line and the first AND gate receives a second signal which corresponds to a voltage on the second power/communication line.

11. The air conditioning system according to claim 10, wherein the indoor unit further comprises a load device power supply to supply the power to the load device.

12. The air conditioning system according to claim 10, wherein the duplicate power application prevention unit comprises a logic circuit to receive a voltage applied to the power/communication line and the power application signal from the microcomputer as an input.

13. The air conditioning system according to claim 10, wherein the logic circuit further comprises an OR gate to receive an output signal from the first AND gate as an input.

14. The air conditioning system according to claim 13, wherein the logic circuit further comprises a second AND gate to receive an output signal from the OR gate and the power application signal from the microcomputer as an input.

15. The air conditioning system according to claim 14, wherein the duplicate power application prevention unit further comprises a first transistor and a second transistor switched in response to an output signal from the second AND gate.

16. A method, comprising:

outputting, by a processor, a signal from a first indoor air conditioning unit to supply power to a load device via a power/communication line;

preventing, by the processor, the first indoor air conditioning unit from supplying power to the load device when power is simultaneously supplied by a second indoor air conditioning unit; and optically isolating, using at least one photo-coupler, at least one input of a duplicate power application prevention unit from the power/communication line, wherein the power/communication line comprises the first power/communication line and the second power/communication line, and wherein the duplicate power application prevention unit comprises a first AND gate to receive a first signal which corresponds to a voltage on the first power/communication line and the first AND gate receives a second signal which corresponds to a voltage on the second power/communication line.

* * * * *